United States Patent [19]

Kiba et al.

[11] Patent Number: 4,726,579

[45] Date of Patent: Feb. 23, 1988

[54] SHEET STACKING ARRANGEMENT

[75] Inventors: Akira Kiba; Hidekazu Nakagami, both of Toyohashi, Japan

[73] Assignee: Minolta Camera Kabushiki Kaisha, Osaka, Japan

[21] Appl. No.: 596,825

[22] Filed: Apr. 3, 1984

[30] Foreign Application Priority Data

Apr. 12, 1983 [JP] Japan ..... 58-64221

[51] Int. Cl.[4] ..... B65H 29/00

[52] U.S. Cl. ..... 271/186; 271/210; 271/312; 271/902

[58] Field of Search ..... 271/186, 65, 66, 67, 271/68, 69, 70, 207, 209, 210, 213, 223, 224, 902, 185, 188, 312, 311

[56] References Cited

U.S. PATENT DOCUMENTS

| | | | |
|---|---|---|---|
| 3,046,008 | 7/1982 | Velvel | 271/186 |
| 4,300,757 | 11/1981 | Koiso et al. . | |
| 4,386,864 | 6/1983 | Wang et al. | 271/65 X |
| 4,441,702 | 4/1984 | Nagel et al. | 271/177 |

FOREIGN PATENT DOCUMENTS

| | | | |
|---|---|---|---|
| 0056456 | 5/1981 | Japan | 271/186 |
| 77157 | 5/1982 | Japan | 271/185 |

OTHER PUBLICATIONS

Manning, D. F. et al., "Sheet Stacking Technique", IBM Technical Disclosure Bulletin, vol. 17, No. 8, Jan. 1975, p. 225.

*Primary Examiner*—H. Grant Skaggs

*Attorney, Agent, or Firm*—Wenderoth, Lind & Ponack

[57] ABSTRACT

An improved sheet stacking arrangement for use with a recording apparatus, which includes a sheet feed-out device, a tray provided with an inclined surface descending to a certain extent towards the recording apparatus, and a sheet leading edge restricting portion provided at a side of the recording apparatus beyond an intersection between the inclined surface of the tray and an imaginary line extending in the sheet feed-out direction of the sheet feed-out device so as to receive the leading edge of the sheet fed out by the sheet feed-out device and contacting the inclined surface of the tray, with tray distance between the sheet feed-out device and the tray being shorter than the length of the shortest sheet employed in the recording apparatus.

12 Claims, 8 Drawing Figures

SHEET STACKING ARRANGEMENT

BACKGROUND OF THE INVENTION

The present invention relates to a sheet stacking arrangement for stacking up or piling up sheets, for example, paper sheets discharged from a recording apparatus such as a copying machine and the like, by turning over such paper sheets as they are discharged.

Conventionally, in the recording apparatuses such as copying machines, etc., it has generally been so arranged that paper sheets are discharged, with the recorded surfaces thereof directed upwards, while, for the sheet stacking arrangements provided as auxiliaries to the recording apparatuses of this kind, there have been proposed the so-called face-up system in which the paper sheets are fed in a generally horizontal direction, with their recorded surfaces directed upwards so as to be piled up as they are, and the so-called face-down system in which the paper sheets are turned over so as to be stacked up with their recorded surfaces directed downwards. However, in the former system, the paper sheets are consequently stacked up in the order opposite to that in which they are recorded and, for example, in the case where copying is started from a first page of original documents to be copied, it has been necessary to rearrange the order of pages by exchanging upper sheets with lower sheets, one by one, in the stack of copied paper sheets taken out from the sheet stacking arrangement. Meanwhile, in the latter system of the paper sheet turning-over type, although the copy paper sheets are turned over during processing, they are consequently stacked up normally in the order of pages, without necessity for the rearrangement of the paper sheets as in the former system.

On the other hand, it is convenient to employ a sorter for the classification of paper sheets discharged from the recording apparatus, but in this case, the sorter itself is of a large scale, requiring a high cost for installation. Accordingly, there has been proposed a recording apparatus equipped with a simplified classification mechanism which is arranged to stack up paper sheets by laterally shifting a sheet discharge tray after copying of a predetermined number of sheets in such a manner as to form steps in the lateral direction.

Incidentally, for classifying paper sheets through employment of the classification mechanism as described above, it is desirable that the respective paper sheets be accommodated in the paper discharge tray with the leading edges of said sheets being correctly aligned, and thus, a high accuracy in stacking is required.

In the conventional sheet stacking arrangements, however, it has been impossible to stack up the sheets with the leading edges thereof correctly aligned, the arrangement being very poor in stacking accuracy, and even when the classification mechanism has been employed, it has not been very convenient to use.

SUMMARY OF THE INVENTION

Accordingly, an essential object of the present invention is to provide a sheet stacking arrangement of a paper sheet turning-over type, which is superior in stacking accuracy and highly efficient in operation.

Another important object of the present invention is to provide a sheet stacking arrangement of the above described type, which is simple in construction and stable in functioning, and can be readily incorporated into various recording apparatuses at low cost.

In accomplishing these and other objects, according to one preferred embodiment of the present invention, there is provided a sheet stacking arrangement for use with a recording apparatus, comprising a sheet feed-out means which receives each of the sheets discharged from the recording apparatus with its recorded surface directed upwards, and feeds out the sheet downwardly, with the leading edge thereof slightly directed slightly towards the side of the recording apparatus so that the surface of the sheet opposite to its recorded surface is directed upwards, a tray provided below the sheet feed-out means and provided with an inclined surface descending to a certain extent towards the recording apparatus, and a sheet leading edge restricting means provided at a side of the recording apparatus beyond the intersection between the inclined surface of the tray and an imaginary line extended in the sheet feed-out direction of the sheet feed-out means so as to receive the leading edge of the sheet fed out by the sheet feed-out means and contacting the inclined surface of the tray, with the distance between the sheet feed-out means and the tray being set to be shorter than the length of the shortest sheet employed in the recording apparatus.

By the construction of the present invention as described above, an improved sheet stacking arrangement of a sheet turning-over type which is efficient in operation and stable in functioning has been advantageously provided and which has a simple construction, with a substantial elimination of disadvantages inherent in the conventional arrangements of this kind.

BRIEF DESCRIPTION OF THE DRAWINGS

These and other objects and features of the present invention will become apparent from the following description of the preferred embodiments thereof taken in conjunction with to the accompanying drawings, in which.

DETAILED DESCRIPTION OF THE INVENTION

Figure 1:
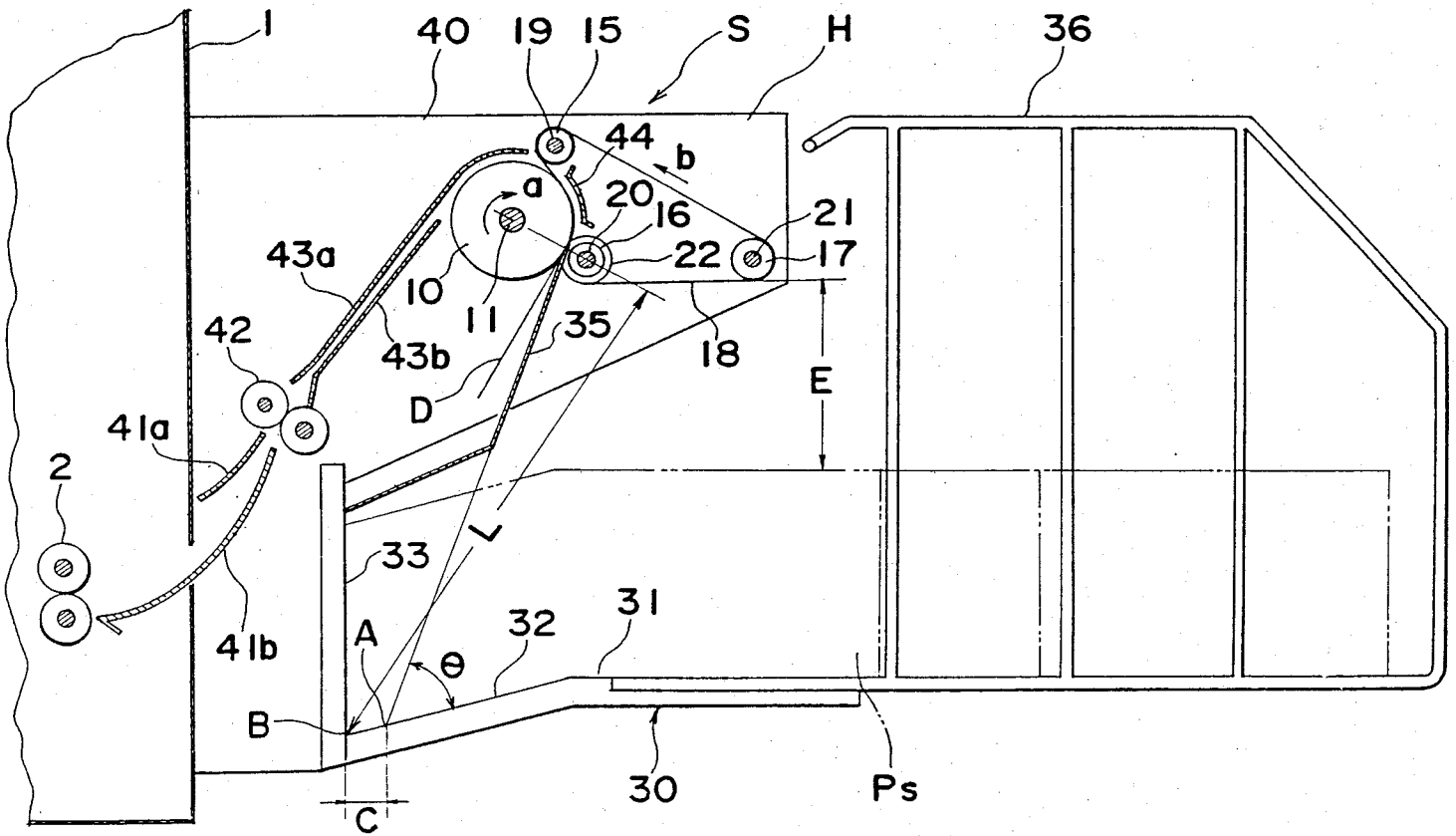
FIG. 1 is a schematic side sectional view of a sheet stacking arrangement according to one preferred embodiment of the present invention associated with a recording apparatus.

Before the description of the present invention proceeds, it is to be noted that like parts are designated by like reference numerals throughout the accompanying drawings.

Referring now to the drawings, there is shown in FIG. 1, a sheet stacking arrangement S according to one preferred embodiment of the present invention, which is disposed at a sheet discharge side of a recording apparatus, e.g., a copying machine 1 so as to receive paper sheets having copied images on the surfaces thereof by the known electrographic process in the copying machine 1, and discharged into said sheet stacking arrangement S through a pair of discharge rollers 2 provided in said copying machine.

More specifically, the sheet stacking arrangement S generally includes a housing H having a pair of spaced side walls 40, a discharge roller 10 of a comparatively large diameter rotatably supported between the side walls 40 on a shaft 11, an endless belt 18 passed around these rollers 15, 16 and 17 also rotatably rotated between the side walls 40 on corresponding shafts 19, 20 and 21, a sheet guide plate 35 directed downwardly from between the rollers 10 and 16, a tray 30 disposed at the lower portion of the arrangement S, and a guide cage 36 provided at the right-hand side as shown in FIG. 1. The discharge roller 10 receives the rotational force from the shaft 11 for rotation in a direction indicated by an arrow "a". The endless belt 18 is arranged to be pressed against the peripheral surface of the discharge roller 10 of the large diameter at its portion between the rollers 15 and 16 so as to be moved in a direction indicated by an arrow "b", following rotation of the discharge roller 10. Moreover, for leading the paper sheets discharged through the discharge rollers 2 of the copying machine 1, to the peripheral surface of the discharge roller 10, there are further provided, along the path of the paper sheets, opposed guide plates 41*a* and 41*b*, a pair of intermediate guide rollers 42, and opposed guide plates 43*a* and 43*b* as shown, with the upper portion of the guide plate 43*a* being curved along the peripheral surface of the discharge roller 10 so as to extend up to a position in the vicinity of the discharge roller 15. Another guide plate 44 is further provided along the discharge roller 10 between the rollers 15 and 16 and inside the endless belt 18.

The tray 30 mounted on the side walls 40 by a shifting means or classification mechanism 50 to be described later (FIG. 6) includes a bottom portion 31 having an inclined portion 32 directed slantwise downwardly towards the copying machine 1, and a sheet leading edge restricting portion 33 extending upwardly at right angles from the front edge of said inclined portion 32. The sheet guide plate 35 extends downwardly from the contacting portion between the rollers 10 and 16 at an inclination at an angle $\theta$ with respect to the inclined portion 32 of the tray 30 and is bent generally in a horizontal direction in the course of its extension. The guide cage 36 made, for example, of a metallic wire or the like is mounted on the tray 30 to prevent the paper sheets from slipping off sidewise.

The movements of the paper sheets within the sheet stacking arrangement S as described so far will be explained with reference to FIGS. 2 through 5.

Figure 2:
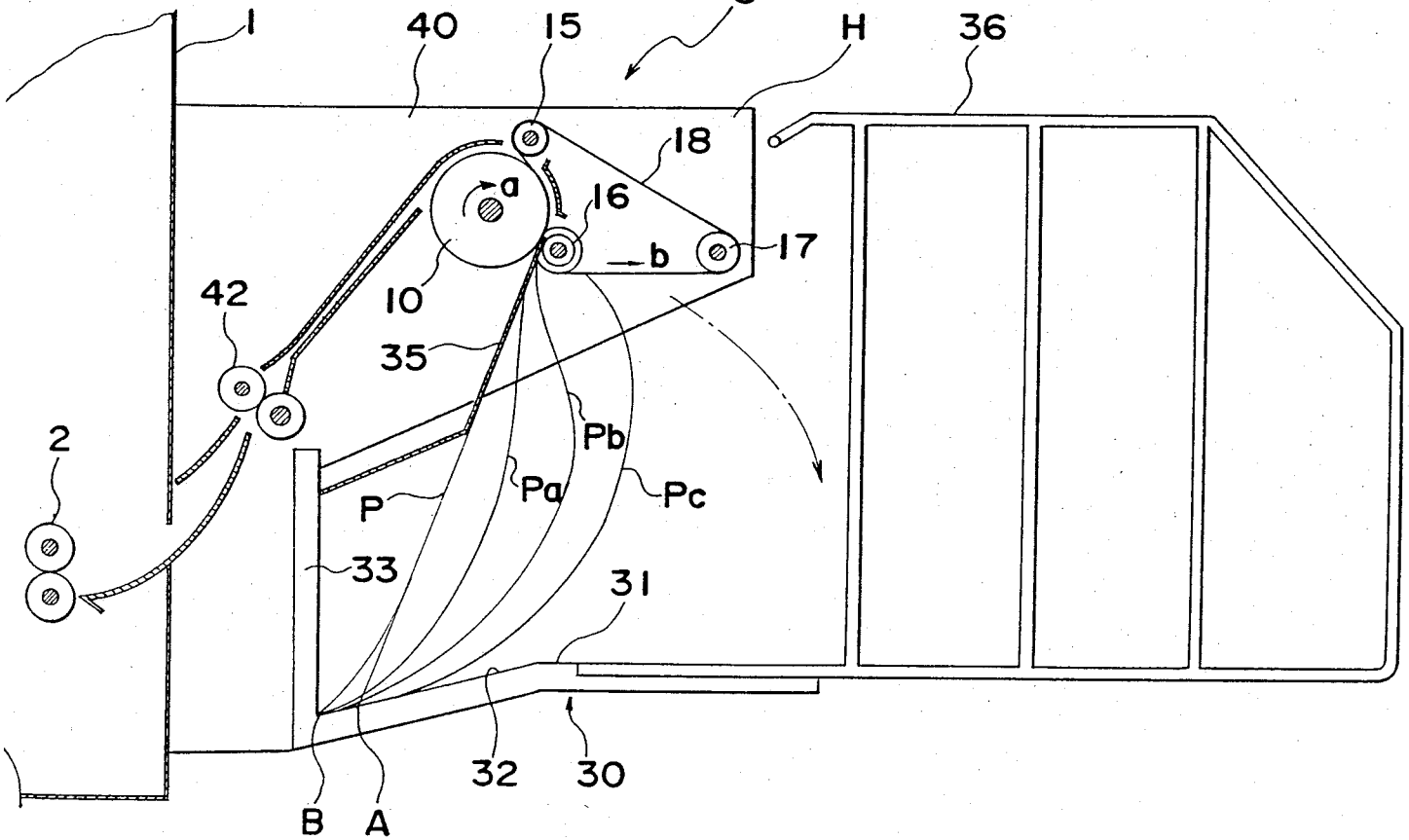
FIGS. 2 through 5 are views similar to FIG. 1, which particularly show movements of paper sheets therein.

In the first place, the movements will be described with respect to paper sheets of the minimum size, for example, on a lateral feeding of A4 size paper sheets employed in the copying machine 1. As shown in FIG. 2, each of the paper sheets P discharged from the discharge rollers 2 of the copying machine 1 is transported onto the peripheral surface of the discharge roller 10 by the intermediate guide rollers 42 through the guide plates 41*a* and 41*b* and 43*a* and 43*b* and is held, at its leading edge, between the discharge roller 10 and the endless belt 18 so as to be fed in the direction of the arrow "a". After passing through between the rollers 10 and 16, the paper sheet P moves along the sheet guide plate 35, and thus, the leading edge of the first paper sheet P reaches a point A on the inclined portion 32 of the tray 30. Subsequently, the leading edge of the paper sheet P slips forwardly along the surface of the inclined portion 32 and arrives at a point B at the lower end of the sheet leading edge restricting portion 33. Since the paper sheet P is further fed out by the discharge roller 10 and the endless belt 18, it forms a loop or curve towards the rear portion of the tray 30. The loop thus formed in the paper sheet P is expanded in the order as shown at Pa, Pb and Pc, and the trailing edge of the paper sheet P fed out from between the discharge roller 10 and the endless belt 18 contacts the surface of the moving endless belt 18 by its resiliency so as to be fed to a certain extent in the direction of the arrow "b" and, after being kicked out towards the rear portion of the tray 30, is discharged onto the bottom portion of the tray 30 in a turned-over state.

The paper sheets P after the first sheet show similar movements, and are successively stacked thereupon in the turned-over state, with their leading edges contacting the sheet leading edge restricting portion 33.

Figure 3:
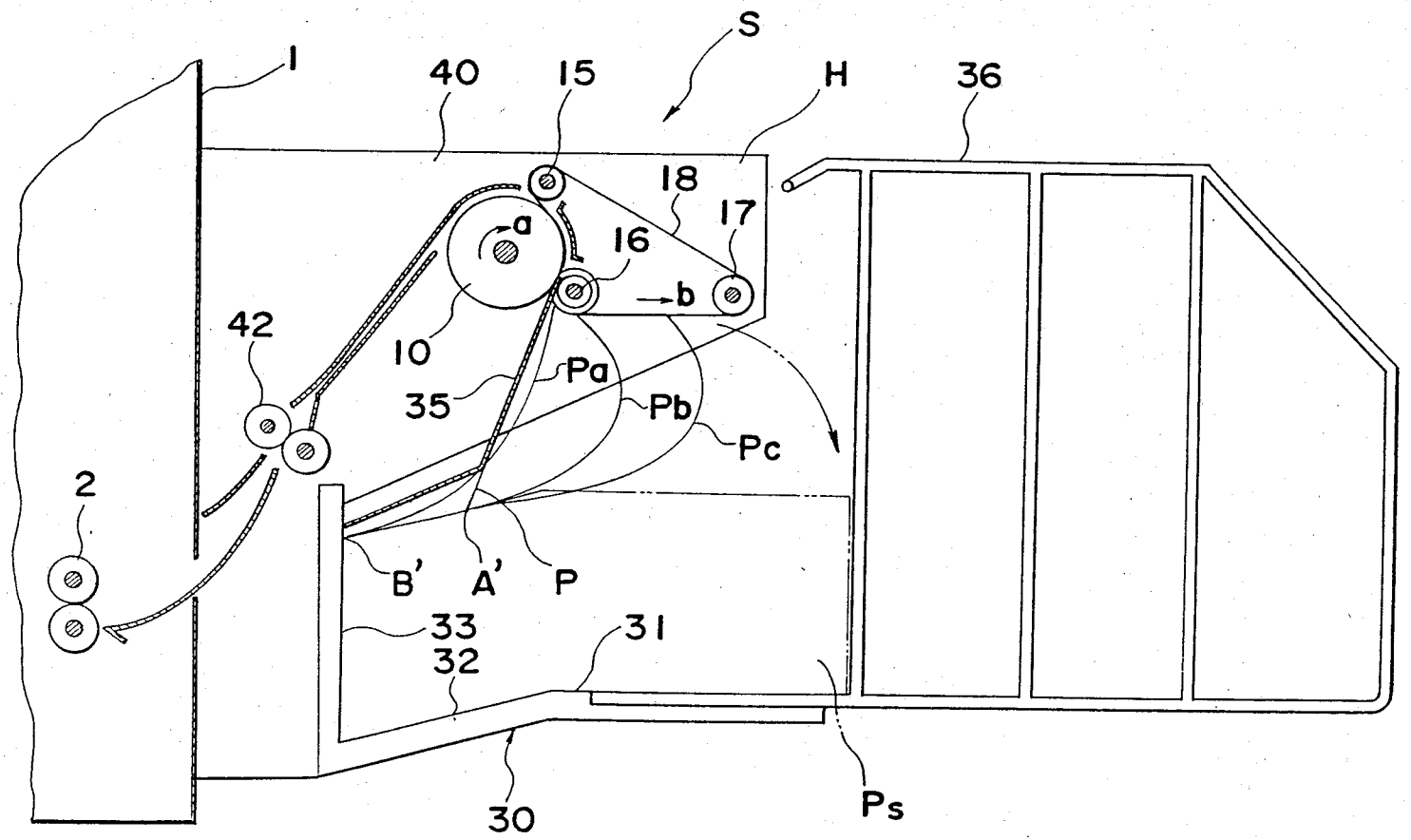

FIG. 3 shows the movement of the paper sheet P in a state where the tray 30 is almost filled with stacked up sheets as at Ps. In this state, the point A′ which the leading edge of the paper sheet P contacts is located on the stack Ps of the paper sheets which have already been stacked up, and is shifted behind the point A in FIG. 2. The leading edge of the paper sheet P slides over the top sheet of the paper sheet stack Ps, and come into contact with a point B′ on the sheet leading edge restricting portion 33 of the tray 30. At this time, the paper sheet P is already formed with the loop Pa which is successively expanded to the loops Pb and Pc, and thus, each paper sheet P is further piled up on the stack Ps after the trailing edge thereof has been separated from the endless belt 18.

Figure 4:
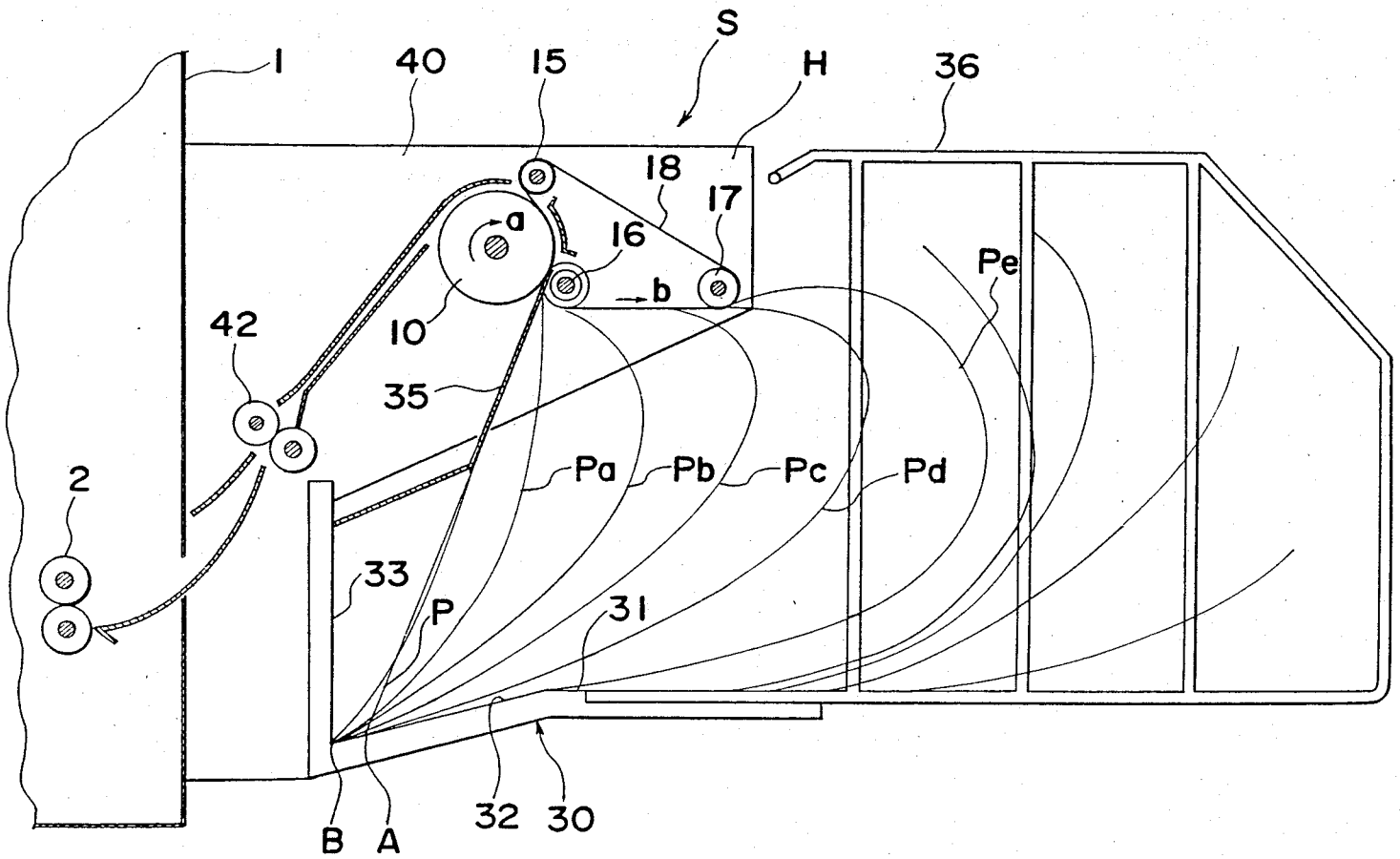
Figure 5:
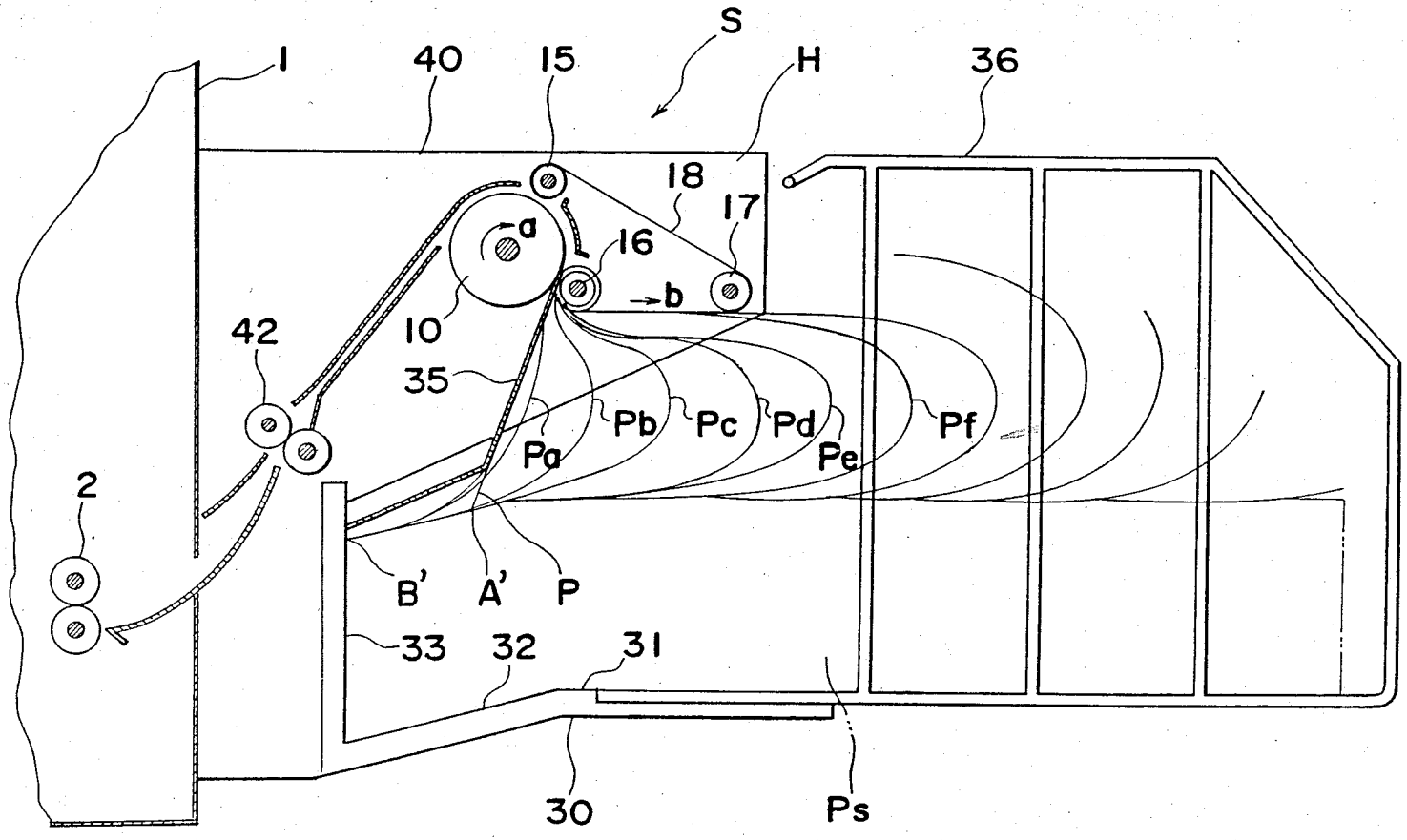

The movements of paper sheets of the maximum size (e.g., longitudinal feeding of A3 size paper sheets) to be employed in the copying machine 1 are as shown in FIGS. 4 and 5, which are fundamentally similar to the movements of the paper sheets of the minimum size described with reference to FIGS. 2 and 3.

More specifically, as shown in FIG. 4, the leading edge of the first paper sheet P is displaced from the point A to the point B, with the loop successively expanded in the order Pa, Pb, Pc, Pd, Pe and so on, and the trailing edge of the paper sheet P is kicked out rearwardly from a portion of the belt 18 at the roller 17 so that the paper sheet P is stacked up on the tray 30. In the state where the paper sheets have been almost fully loaded on the tray 30 as shown in FIG. 5, the leading edge of the paper sheet P moves over the stack Ps of the paper sheets already piled up, from the point A′ to the point B′. The paper sheet P is successively formed with elongated loops Pa, Pb, Pc, Pd, Pe, Pf and so on, and the trailing edge of the paper sheet is kicked out rearwardly from the portion of the belt 18 at the roller 17 in a similar manner to the first sheet so as to be further piled up on the stack Ps.

The conditions for the paper sheets to effect the movements as described so far and also, to be correctly aligned at the leading edges thereof, will be described hereinbelow.

Referring back to FIG. 1, in the first place, it is necessary that the sheet guide plate 35 extend in the direction of feed-out of the sheets along a tangential line D from the rollers 10 and 16 or is inclined towards the right from the feed-out direction on line D for guiding the leading edge of the paper sheet slantwise downwardly and the angle $\theta$ between an extension of an imaginary line from the guide plate 35 and the inclined portion 32 of the tray 30 should preferably be in a range of 30° to 60°. For correctly aligning the leading edges of the paper sheets, it is required that the leading edge of the paper sheet slips forwardly to contact the point B after having contacted the point A so as to form the loop at the right side of the paper sheet as described earlier with reference to FIGS. 2 to 5. Accordingly, it is necessary that the distance L from the contact point between the rollers 10 and 16 to the point B be shorter than a length of the minimum sized paper sheet, while a certain distance C must be provided between the points A and B. Furthermore, the distance E from the top sheet on the stack Ps to the endless belt 18 between the rollers 16 and 17 should be at least 30 mm for the formation of the loop in the paper sheet.

By adopting the conditions as described so far, it becomes possible to stack up various paper sheets ranging from those longer in length than the distance L, to those of the maximum size which can be accommodated in the tray, including paper sheets having sizes intermediate therebetween, with the leading edges thereof correctly aligned.

On the other hand, for bringing leading edges of paper sheets not so tough or leading edges of various paper sheets positively into contact with the sheet leading edge restricting portion 33, it is preferable to provide so-called side rollers 22 at opposite ends of the roller 16. Moreover, if a large number of fine grooves (not particularly shown) are formed on the surface of the endless belt 18 in a direction intersecting at right angles with the moving direction of said belt 18, the function of kicking out the trailing edge of the paper sheet can be improved. Furthermore, by taking into account the case where the difference between the minimum length and the maximum length of the paper sheets is large or thick paper sheets are to be dealt with, if there is employed a movable type paper sheet presser (not particularly shown) which may be pushed upwardly by the inserting force of the paper sheet acting in a direction generally at right angles to the paper sheet leading edge restricting portion 33, the alignment at the leading edges of the paper sheets can be still further improved. If the tray 30 is modified to be vertically movable, with spring means attached thereto for balancing the weight of the stacked paper sheets, still more paper sheets may be stacked.

It is also to be noted that the endless belt need not necessarily be passed around the three rollers 15, 16 and 17, but may be directed between the rollers 16 and 17, with the roller 15 omitted, although a guide means for positively guiding the leading edge of the paper sheet between the rollers 10 and 16 is separately required. However, if the conditions described earlier are satisfied, any route may be selected for the paper sheet transport path from the discharge rollers 2 of the copying machine 1 to the rollers 10 and 16 of the sheet stacking arrangement according to the present invention.

Figure 6:
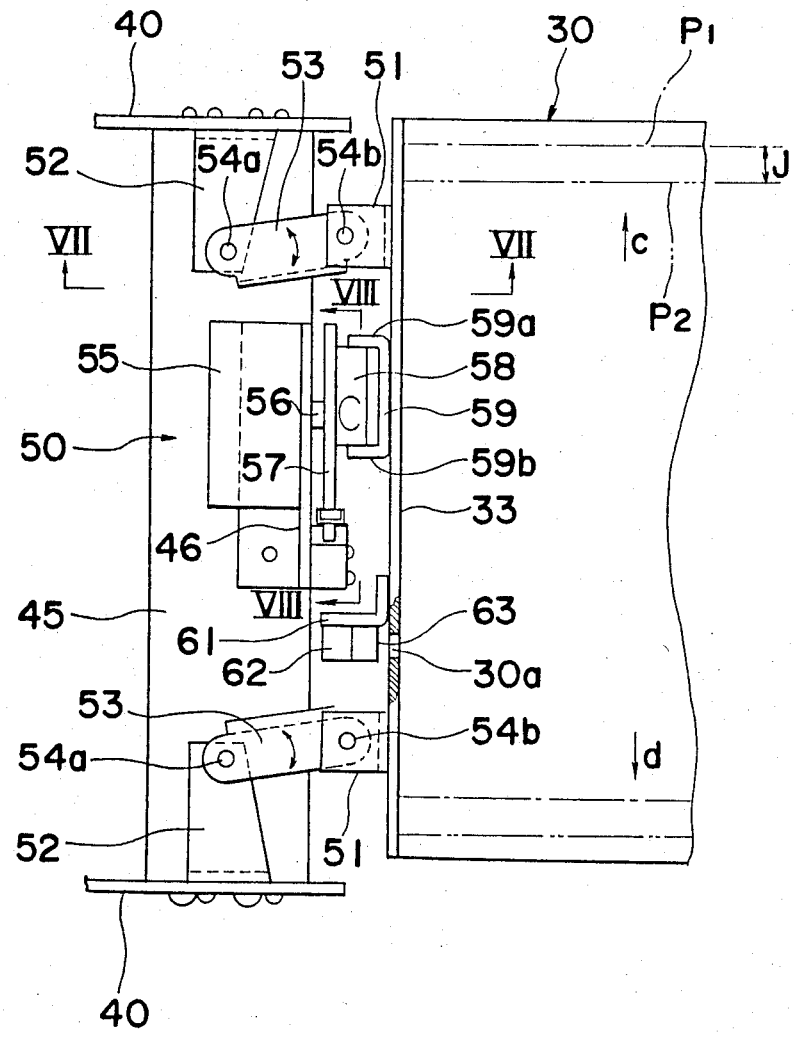
FIG. 6 is a fragmentary top plan view, partly in section, of a classification mechanism employed in the arrangement of FIG. 1.
Figure 7:
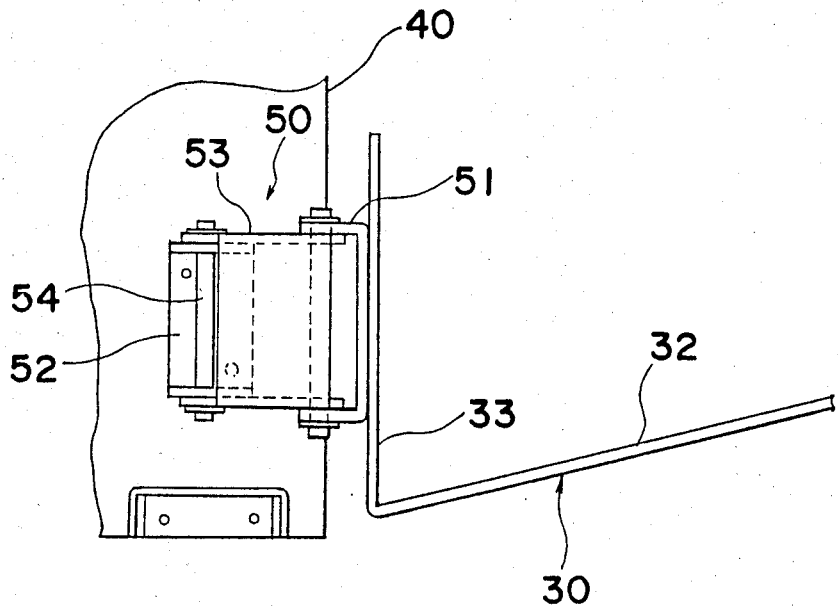
FIG. 7 is a cross section taken along the line VII—VII in FIG. 6.
Figure 8:
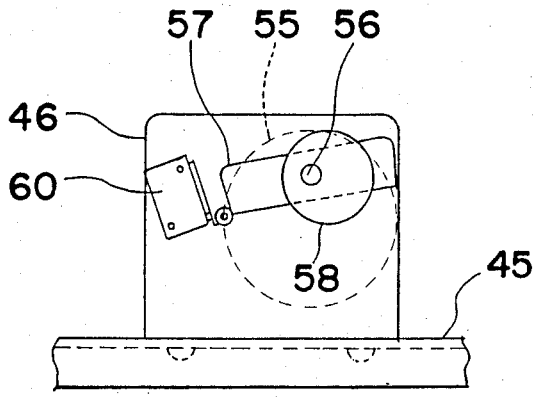
FIG. 8 is a cross section taken along the line VIII—VIII in FIG. 6.

Referring to FIGS. 6, 7 and 8, the shifting means or classification mechanism 50 for laterally shifting the tray 30 for classifying paper sheets in stacks of a predetermined number will be explained hereinbelow.

The tray 30 is provided with a pair of spaced brackets 51 fixed to the sheet leading edge restricting portion 33 thereof, and connected to corresponding brackets 52 secured to the side walls 40 through arms 53 and pins 54*a* and 54*b*, and is adapted to be pivotable in the lateral direction in a horizontal plane about the pins 54*a*. Moreover, on a bottom plate 45 provided between the side walls 40, a motor 55 is mounted on a bracket 46, and a detecting plate 57 and an eccentric cam 58 are fixed on an output shaft 56 of the motor 55, with the eccentric cam 58 being engaged between a pair of spaced projections 59*a* and 59*b* of a contact member 59 secured to the paper sheet leading edge restricting portion 33. A microswitch 60 fixed to the bracket 46 is arranged to be turned on and off by the detecting plate 57 rotating as one unit with the eccentric cam 58.

By the above arrangement, when the motor 55 is started and the eccentric cam 58 is rotated towards the right side as shown in FIG. 8, the peripheral surface of the eccentric cam 58 depresses the projection 59*a* to displace the tray 30 in the direction indicated by an arrow "c", and the started motor 55 is shut down upon actuation of the microswitch 60 by one end of the detecting plate 57. Then, when the motor 55 is again started to rotate the eccentric cam 58, the peripheral surface of said eccentric cam depresses the projection 59*b* to displace the tray 30 in a direction indicated by an arrow "d", and the started motor 55 is stopped upon actuation of the microswitch 60 by the other end of the detecting plate 57.

In other words, for each half rotation of the eccentric cam 58, the tray 30 effects a movement similar to a rocking motion for the lateral displacement. During the movement of the tray 30 in the direction of the arrow "c", paper sheets are stacked up, with a one-dot chain line P1 as a standard line, while during the displacement of the tray 30 in the direction of the arrow "d", paper sheets are piled up, with a two-dot chain line P2 as a standard line. It is to be noted that the amount of eccentricity of the eccentric cam 58 is equivalent to ½ of the amount of displacement J of the tray 30.

With respect to the timing for displacing the tray 30, if the recording apparatus is of a copying machine provided with an original document automatic feeding device, the motor 55 is arranged to be started by an original document replacing signal. In this case, it is necessary that the displacement of the tray 30 be completed before a first paper sheet copied from a subsequent original document falls onto the tray 30. In a printer or the like in which the number of sheets to be copied from one original document is programmed, it may be so arranged that the motor 55 is started at each copying completion signal for each of the original documents. Of course, it is possible to arrange to start the motor 55 at times desired by an operator through provision of a change-over switch.

In the sheet stacking arrangement of the type as described so far, it is required to provide means for detecting that paper sheets have been fully stacked up and loaded thereon. According to the present embodiment, as shown in FIG. 6, a microswitch 62 is mounted on the sheet leading edge restricting portion 33 on a bracket 61, with an actuating wire 63 thereof extending into the tray 30 through an opening 30*a* to detect when the paper sheets are fully loaded. The reason for mounting the microswitch 61 for the paper sheet detection on the movable tray 30 is to avoid such an inconvenience that, if the microswitch 62 is attached to the stationary side, the paper sheets are brought into contact with the actuating wire 62 by the movement of the tray 30, thus resulting in a positional deviation of the paper sheets.

As is clear from the foregoing description, according to the present invention, the sheet stacking arrangement includes the sheet feed-out means which receives each of sheets discharged from the recording apparatus with its recorded surface directed upwards and feeds out the sheet downwardly, with the leading edge thereof slightly directed towards the recording apparatus so that the surface of the sheet opposite to its recorded surface is directed upwards, the tray provided below the sheet feed-out means and formed with the inclined surface descending to a certain extent towards the recording apparatus, and the sheet leading edge restricting means provided on the side toward the recording apparatus beyond the intersection between the inclined surface of the tray and the imaginary line extended in the sheet feed-out direction from the sheet fed out by the sheet feed-out means and contacting the inclined surface of the tray, with the distance between the sheet feed-out means and the tray being set to be shorter than the length of the shortest sheet employed in the recording apparatus. The sheet feed-out means further includes the discharge roller rotatably provided so as to be driven for rotation, and the belt member adapted to move in contact with the discharge roller, with the belt member being so provided as to push out the trailing edge of each of the sheets fed out between the discharge roller and the belt member in a direction away from the recording apparatus. The sheet stacking arrangement further comprises the shift means for laterally shifting the tray with respect to the direction of advancing of the sheets.

Accordingly, in the present invention, it is possible to stack up the sheets on the tray, with the leading edges of the sheets positively positioned by the sheet leading edge restricting portion, and thus, the sheet stacking arrangement provides a high stacking accuracy regardless of differences in the sizes of sheets, through a simple construction.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A sheet stacking arrangement for use with a recording apparatus, comprising:

a sheet feed-out means positioned to one side of the recording apparatus for receiving each of the sheets discharged from the recording apparatus with the surface of the sheets having material recorded thereon directed upwards and feeding the sheets downwardly in a feed-out direction extending toward the one side of the recording apparatus;

a sheet guide means including a flat guide surface below said sheet feed-out means and extending in a sheet guiding direction for guiding the leading edge of a sheet slightly back toward the recording apparatus so that the surface of the sheet opposite to the surface with the material thereon is directed upwards, the sheet guiding direction being inclined to said feed-out direction, said sheet feed-out direction being between the sheet guiding direction and the recording apparatus so that each sheet fed out of said sheet feed-out means in the feed-out direction contacts said flat surface of said sheet guide means and is guided therealong;

a tray provided below said sheet feed-out means and having an inclined surface descending to a certain extent toward the recording apparatus, said inclined surface intersecting with said sheet guiding direction; and a sheet leading edge restricting means provided at the end of said inclined surface toward the recording apparatus beyond the intersection between the inclined surface and an imaginary line extending in the sheet guiding direction for receiving the leading edge of the sheets fed out by said sheet feed-out means, the distance between said sheet feed-out means and the junction of said restricting means and said inclined surface being less than the length of the shortest sheet employed in the recording apparatus.

2. A sheet stacking arrangement as claimed in claim 1 wherein said sheet feed-out means further includes a rotatably mounted discharge roller and means for driving said discharge roller in rotation, and a belt member movable in contact with said discharge roller to the point of discharge of the sheets from said sheet feed-out means, said belt member further extending and moving laterally from said point of discharge in a direction away from the recording apparatus for pushing the trailing edge of each of the sheets fed out from between said discharge roller and said belt member in a direction away from said recording apparatus.

3. A sheet stacking arrangement as claimed in claim 2, further including a shift means for laterally shifting said tray with respect to a direction of advancing of the sheets.

4. A sheet stacking arrangement as claimed in claim 3 wherein said sheet feed-out means further includes a pair of discharge rollers contacting each other for discharging the sheets in a direction tangent to the point of contact of said discharge rollers.

5. A sheet stacking arrangement as claimed in claim 4 wherein said sheet feed-out means further includes a belt member extending and moving laterally from said discharge rollers in a direction away from the recording apparatus for pushing the trailing edge of each of the sheets fed out from between said discharge rollers in a direction away from the recording apparatus.

6. The sheet stacking arrangement as claimed in claim 1 wherein said sheet feed-out means further includes a pair of discharge rollers contacting each other for discharging the sheets in a direction tangent to the point of contact of said discharge rollers.

7. The sheet stacking arrangement as claimed in claim 6 wherein said sheet feed-out means further includes a belt member extending and moving laterally from said discharge rollers in a direction away from the recording apparatus for pushing the trailing edge of each of the sheets fed out from between said discharge rollers in a direction away from the recording apparatus.

8. A sheet stacking arrangement as claimed in claim 6, wherein said flat guide surface of said sheet guide means is formed by a guide plate extending in the sheet guiding direction from said sheet feed-out means for guiding the sheet.

9. A sheet stacking arrangement as claimed in claim 1, wherein an angle formed between said inclined surface of said tray and said imaginery line extending in the sheet guiding direction is in the range of about 30° to 60°.

10. A sheet stacking arrangement as claimed in claim 1, wherein said sheet guide means is a straight plate.

11. A sheet stacking arrangement as claimed in claim 1, wherein said sheet feed-out means further includes a push means for pushing out the trailing edge of the sheet away from the recording apparatus and for inverting the sheet upside down, the distance between said push means and said tray being less than the length of the shortest sheet employed in the recording apparatus.

12. A sheet stacking arrangement for use with a recording apparatus, comprising:

a sheet feed-out roller means positioned to one side of the recording apparatus for receiving each of the sheets discharged form the recording apparatus with the surface of the sheets having material recorded thereon directed upward sand feeding the sheets downwardly in a feed-out direction extending toward the one side of the recording apparatus;

a sheet guide means including a flat guide surface below said sheet feed-out roller means and extending in a sheet guiding direction for guiding the leading edge of a sheet slightly back toward the recording apparatus so that the surface of the sheet oppsoite to the surface with the material thereon is directed upwards, the sheet guiding direction being inclined to said feed-out direction, said sheet feed-out direction being between the sheet guiding direction and the recording apparatus so that each sheet fed out of said sheet feed-out roller means in the feed-out direction contacts said flat surface of said sheet guide means and is guided therealong;

a side roller means provided at opposite sides of said sheet feed-out roller means for bringing the leading edge of the sheets fed from said sheet feed-out roller means into positive contact with said sheet guide means;

a tray provided below said sheet feed-out roller means and having an inclined surface descending to a certain extent toward the recording apparatus, said inclined surface intersecting with said sheet guiding direction; and a sheet leading edge restricting means provided at the end of said inclined surface toward the recording apparatus beyond the intersection between the inclined surface and an imaginary line extending in the sheet guiding directio for receiving the leading edge of the sheets fed out by said sheet feed-out roller means, the distance between said sheet feed-out roller means and the junction of said restricting means and said inclined surface being less than the length of the shortest sheet employed in the recording apparatus.

* * * * *